US007717140B2

(12) United States Patent
Bächtold

(10) Patent No.: US 7,717,140 B2
(45) Date of Patent: May 18, 2010

(54) NARROW CRANKED HEALD

(75) Inventor: Julius Bächtold, Wilen b. Wollerau (CH)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/219,749

(22) Filed: Jul. 28, 2008

(65) Prior Publication Data

US 2009/0025817 A1 Jan. 29, 2009

(30) Foreign Application Priority Data

Jul. 26, 2007 (EP) ..... 07014643

(51) Int. Cl.
*D03C 9/04* (2006.01)
*D03C 9/02* (2006.01)
*D03C 9/06* (2006.01)

(52) U.S. Cl. ..... 139/96; 139/93; 139/94; 139/95

(58) Field of Classification Search ..... 139/93–96
See application file for complete search history.

(56) References Cited

U.S. PATENT DOCUMENTS

| | | | | | |
|---|---|---|---|---|---|
| 644,371 | A | | 2/1900 | Sewall | |
| 1,545,904 | A | | 7/1925 | Kaufmann | |
| 1,932,350 | A | * | 10/1933 | Marx | 139/93 |
| 1,970,175 | A | * | 8/1934 | Kaufmann | 139/96 |
| 2,426,456 | A | * | 8/1947 | Kaufmann | 139/92 |
| 2,450,241 | A | * | 9/1948 | Kaufmann | 139/96 |
| 2,461,497 | A | * | 2/1949 | Kaufmann | 139/92 |
| 2,522,043 | A | * | 9/1950 | Kaufmann | 139/92 |
| 2,529,555 | A | * | 11/1950 | Kaufmann | 139/96 |
| 2,552,487 | A | * | 5/1951 | Kaufmann | 139/96 |
| 2,643,683 | A | * | 6/1953 | Thorpe | 139/96 |
| 2,646,825 | A | * | 7/1953 | Thorpe | 139/96 |
| 2,690,771 | A | * | 10/1954 | Consoletti | 139/96 |
| 2,964,066 | A | * | 12/1960 | Ramseier | 139/95 |
| 2,973,789 | A | | 3/1961 | Palmer | |
| 3,064,688 | A | * | 11/1962 | Suhr | 139/96 |
| 3,349,811 | A | * | 10/1967 | Kaufmann | 139/96 |
| 3,417,789 | A | * | 12/1968 | Graf | 139/96 |
| 3,428,094 | A | * | 2/1969 | Kaufmann | 139/91 |
| 3,548,885 | A | * | 12/1970 | Wagner | 139/96 |
| 4,383,557 | A | * | 5/1983 | Graf | 139/93 |
| 5,078,184 | A | * | 1/1992 | Koch | 139/93 |

(Continued)

FOREIGN PATENT DOCUMENTS

| | | |
|---|---|---|
| CH | 468489 | 2/1969 |

(Continued)

*Primary Examiner*—Bobby H Muromoto, Jr.
(74) *Attorney, Agent, or Firm*—Fitch, Even, Tabin & Flannery; Norman N. Kunitz

(57) ABSTRACT

Healds that consist of a metal ribbon section having the width (B) that is narrower than the total width B+X required for the flat ribbon heald (20). The flat ribbon heald (20) has an essentially non-machined—in any event, not trimmed—edge (9) derived from the metal ribbon section and an edge (10, 11, 12, 13, 14) that has been produced, in the region of the shaft (4) and the transition regions (5, 6), by trimming the metal ribbon section. An outward-directed crank of the shaft (4) creates an enlarged distance (R) between two associate oppositely cranked flat ribbon healds of a heald pair (23) which comprises two oppositely cranked flat ribbon healds (20, 21).

6 Claims, 3 Drawing Sheets

U.S. PATENT DOCUMENTS

| | | | | |
|---|---|---|---|---|
| 5,348,055 | A * | 9/1994 | Kramer | 139/93 |
| 5,474,110 | A * | 12/1995 | Mettler | 139/93 |
| 6,105,623 | A * | 8/2000 | Tonz et al. | 139/93 |
| 6,176,270 | B1 * | 1/2001 | Mettler | 139/93 |
| 6,213,162 | B1 * | 4/2001 | Baechtold | 139/93 |
| 6,230,756 | B1 * | 5/2001 | Baumann et al. | 139/93 |
| 6,283,163 | B1 * | 9/2001 | Kagi | 139/93 |
| 7,017,620 | B2 * | 3/2006 | Mettler et al. | 139/93 |
| 7,204,274 | B2 * | 4/2007 | Mettler | 139/93 |
| 7,287,554 | B2 * | 10/2007 | Mathews | 139/93 |
| 2005/0016613 | A1 * | 1/2005 | Mettler et al. | 139/93 |
| 2005/0087252 | A1 * | 4/2005 | Mettler | 139/92 |
| 2007/0000552 | A1 * | 1/2007 | Mettler et al. | 139/52 |
| 2007/0028985 | A1 * | 2/2007 | Mathews | 139/55.1 |
| 2007/0079887 | A1 * | 4/2007 | Korbutt et al. | 139/93 |
| 2007/0131301 | A1 * | 6/2007 | Mettler | 139/52 |
| 2008/0083471 | A1 * | 4/2008 | Mettler | 139/93 |

FOREIGN PATENT DOCUMENTS

| | | |
|---|---|---|
| DE | 976459 | 9/1963 |
| EP | 1739215 | 1/2007 |
| JP | 2006-265760 | 10/2006 |

* cited by examiner

NARROW CRANKED HEALD

CROSS-REFERENCE TO RELATED APPLICATION

The present application claims the priority of European Patent Application No. 07 014 643.6, filed Jul. 26, 2007, the subject matter of which, in its entirety, is incorporated herein by reference.

BACKGROUND OF THE INVENTION

The invention relates to a flat ribbon heald with an end eyelet, shaft and thread eye, said heald being manufactured of a metal ribbon section.

Healds are manufactured, for example, of flat steel ribbon during a punching operation. In so doing, parts are removed from a specifically cut metal ribbon in order to obtain the desired exterior form of the heald. The removed parts are waste, which considerably contributes to the consumption of material.

At times, it is necessary to provide healds with a crank, in which case, in particular adjacent healds on a heald shaft are cranked, frequently away from each other in opposite direction. As a result of this, an offset is created between the thread eyes of adjacent healds relative to the longitudinal direction of the warp thread in order to facilitate the passage of warp threads between the healds. Paired healds having shafts with different offsets have been known from documents U.S. Pat. No. 7,204,274 B2, and CH 468 489 and DE 10 2005 033 175 B3. Each of these healds has a straight edge, respectively, extending along the shaft and the end eyelet. The achievable intermediate space between the shafts of adjacent healds is limited.

Furthermore, document U.S. Pat. No. 1,545,904 discloses the manufacture of healds of flat material that forms a relatively narrow sheet metal strip. The end eyelets adjoin the shaft in a symmetrical manner, whereby the shaft may be provided with a crank in order to define an enlarged thread passage space between adjacent healds.

Furthermore, document U.S. Pat. No. 2,973,789 discloses a heald set consisting of differently cranked healds, whereby the healds consist of a metallic flat material. Adjoining the end eyelets, the shafts of the healds are cranked and configured in such a manner that an enlarged thread passage space exists between adjacent healds.

Finally, document U.S. Pat. No. 644,371 discloses a heald that has been manufactured of a narrow steel strip, in which the thread eye and the end eyelet have been produced by spreading apart slotted sections. In addition, the shaft of such a heald may be cranked. During a stamping process, the shaft has been flattened on both sides of the thread eyelet in order to effect increased elasticity in longitudinal direction of the warp thread.

Indeed, the production of elongated openings by slitting and widening is a material-saving process; however, this requires a relatively strong material deformation, thus restricting the choice of material and the possibilities of material optimization.

It is the object of the invention to provide a heald and an economical manufacturing process for the production of said heald, this being intended to make possible a material-saving manufacture of high-performance healds.

SUMMARY OF THE INVENTION

This objective is achieved with the flat ribbon heald and the process for manufacturing the flat ribbon heald as disclosed herein:

The flat ribbon heald consists of a metal ribbon section having an original width corresponding to the width at the end eyelet. Material has been removed along the shaft, for example, during a stamping operation or the like. Between the end eyelet and the shaft is a transition section, in which the width is reduced from the end eyelet width to the shaft width. On its end eyelet, the heald has a straight edge that has—at some distance from the end eyelet, either at the transition section or at the shaft—a section extending away from the center line of the heald either in the form of a sharp bend or of an arc. As a result of this, the outer edge of the shaft is offset by an amount X. The center of the thread eye preferably is approximately on a line that connects the outside edges of the end eyelets with each other.

Such a heald can be manufactured of a metal strip having a width that is no greater than the width of the end eyelets. Nerveless, a large offset between the thread eye and the end eyelet may be achieved in longitudinal direction of the warp thread.

Starting with an initially flat ribbon heald—which is preferably planar, i.e., not twisted, and thus its end eyelet, transition section and shaft are located in a common plane, preferably not twisted relative to each other—the shaft is later arranged offset relative to the end eyelets. This offset of the shaft relative to the end eyelets, said offset not yet existing after the cutting out or punching out of the heald but being created later, is achieved by a plastic deformation of the transition region or of a part of the shaft within said plane. This is achieved by an appropriate stamping process. However, it is also possible to combine the punching and stamping steps in one step and to perform these with one tool. Also in this case, a plastic deformation on the shaft or on the transition region achieves the formation of a crank or offset.

Additional details of advantageous embodiments of the invention are obvious from the drawings, the description and the subclaims. The description is restricted to essential aspects of the invention and to miscellaneous situations. The drawings disclose additional details and are to be considered supplementary.

DETAILED DESCRIPTION OF THE INVENTION

Figure 1:
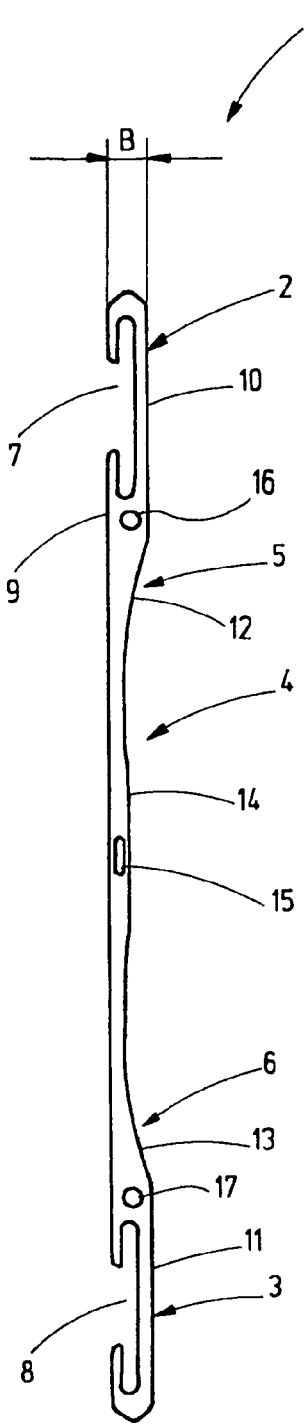
FIGS. 1 and 2 show flat ribbon healds after having been punched out, however, before the cranking or stamping step.

FIG. 1 shows a flat ribbon heald blank 1 that has been punched out of a metal ribbon having the width B. This width B is less than is usual for punched flat ribbon healds. The flat ribbon heald blank 1 has two end eyelets 2, 3, with a shaft 4 provided between them. This shaft adjoins the end eyelets over transition regions 5, 6. During the manufacture of the flat ribbon heald blank 1, openings 7, 8 are applied to the end regions of the sheet metal strip section in order to form end eyelets 2, 3. These openings may have a continuous edge or may also have, as shown, a discontinuous edge. Depending on this, O-shaped end eyelets (as in FIG. 8, for example) or C-shaped end eyelets (as in FIGS. 1 through 6) or J-shaped end eyelets (as in FIG. 7) are created.

The flat ribbon heald blank 1 has a straight edge 9, which extends from the upper end of the upper end eyelet 7 to the lower end of the lower end eyelet 8. This straight edge 9 corresponds to a lateral edge of the original metal ribbon section. However, at the end eyelets 2, 3, only two sections 10, 11, respectively, are still left opposite the straight edge. In a section located in-between, said section comprising the transitions regions 5, 6 and the shaft 4, the material is removed from the metal ribbon section (e.g., by a punching or cutting process), thus creating inward-extending edge sections 12, 13 and an inward-offset edge section 14. In addition, the shaft 4 has been provided with a thread eye 15, in which an appropriate opening has been provided at the desired location. Additional openings 16, 17 may be provided on the end eyelets 2, 3 or in the transition regions 5, 6.

Figure 2:
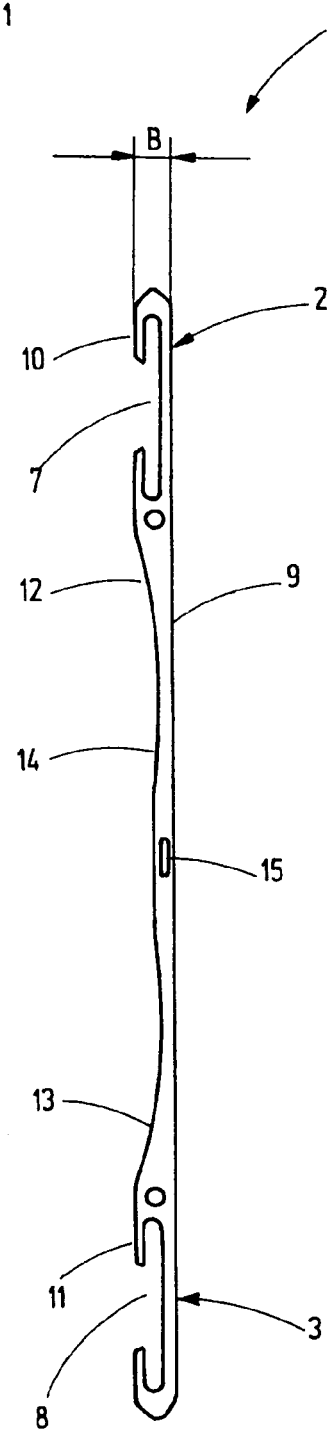

FIG. 2 shows another flat ribbon heald blank 18. While, in the case of the flat ribbon heald blank 1 the straight continuous edge 9 is located on the side of the edge interruption of the openings 7, 8, this continuous edge 9 is provided on the other side of the blank in the case of the flat ribbon heald blank 18 in accordance with FIG. 2 and thus extends continuously over the closed edges of the end eyelets 2, 3. The sections 10, 11 are located on those sides of the end eyelets 2, 3 that have a discontinuous edge. The same applies to the edge sections 12, 13, 14. Other than that, the description of the flat ribbon heald blank 1 applies analogously to that of the heald blank 18, using the same reference numbers.

Figure 3:
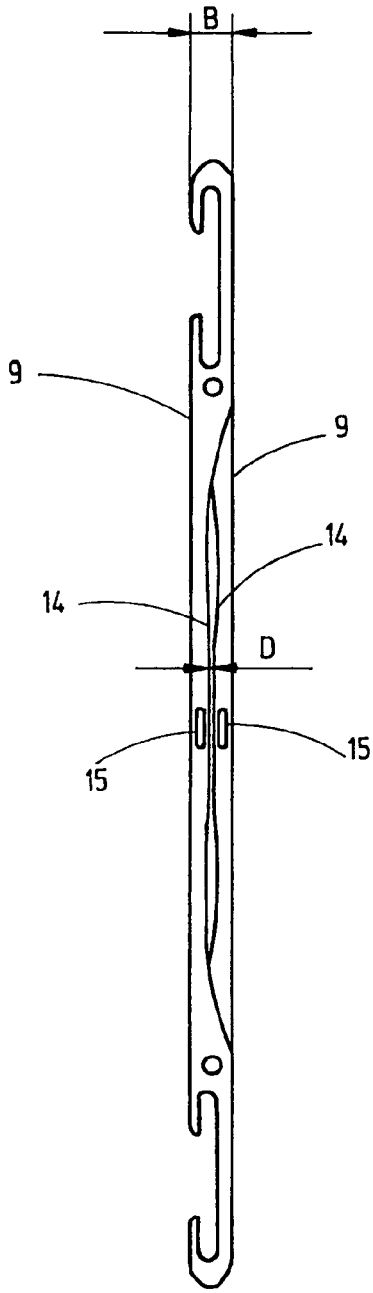
FIG. 3 shows the superimposed flat ribbon heald blanks in accordance with FIGS. 1 and 2.
Figure 4:
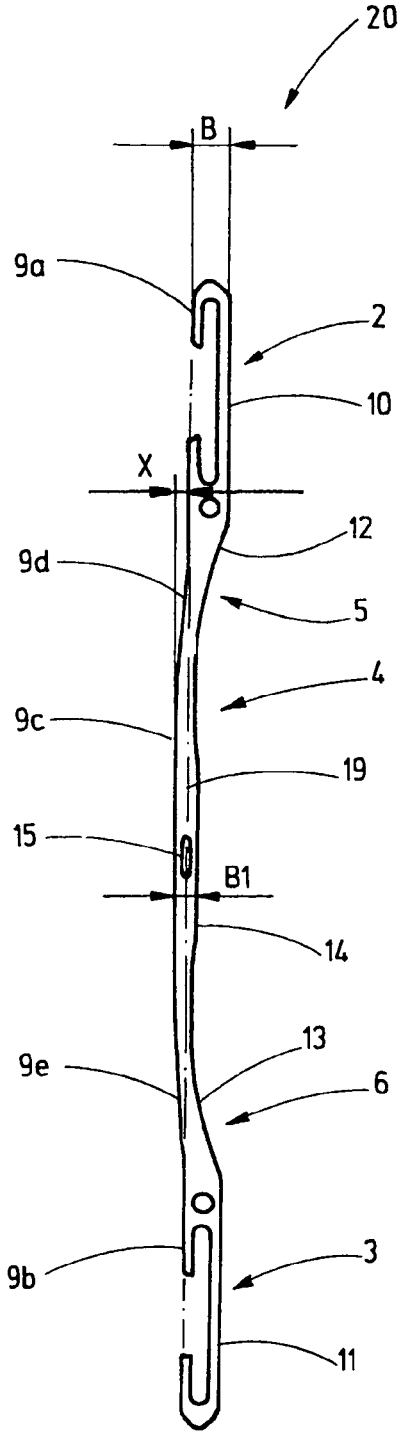
FIGS. 4 and 5 show the flat ribbon healds manufactured from blanks as in FIGS. 1 and 2, following a stamping step.
Figure 5:
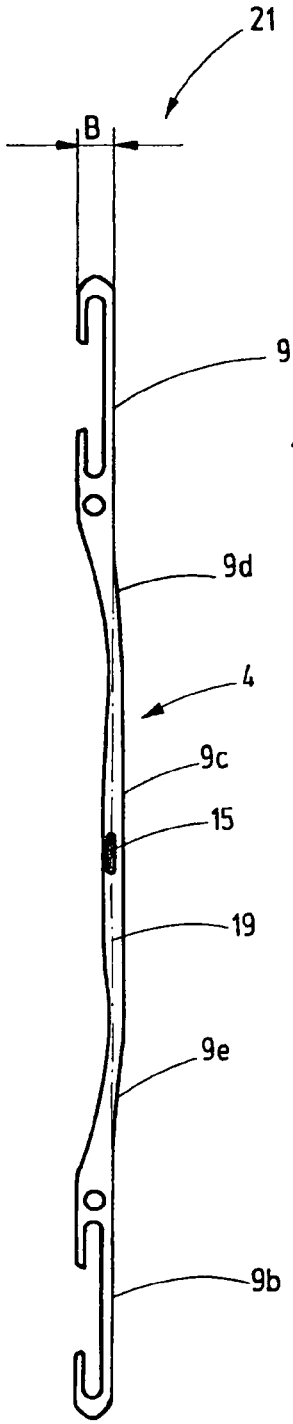

When the two heald blanks 1, 18 are superimposed, the appearance is as in FIG. 3. Remaining between the edge sections 14 is a distance D that is relatively small. Of course, the heald blanks 1, 18 may be installed as healds already in this state, however, due to the minimal distance D, there is the risk of damaging the warp threads that would have to pass between the heald blanks 1, 18.

Therefore, the heald blanks 1, 18 move through another processing step, e.g., a stamping step, in the course of which they are being cranked outward away from each other, e.g., in the transition regions 5, 6. In so doing, they are deformed within the plane defined by the end eyelets 2, 3 and the shaft 4 in such a manner that the thread eye 15 is located on an imaginary line 19, as is marked by the former position of the edge 9. This imaginary line 19 connects the remaining sections 9*a*, 9*b* of the edge 9 that are still present on the end eyelets 2, 3. The center of the thread eye 15 is located on the line 19 or is bent outward beyond said line, i.e., to the left in FIG. 4. This thread eye is arranged in the center section 9*c* of the former edge 9. This section 9*c* is located at a distance X from the line 19. In so doing, the distance X is preferably as great as half the width B1 of the shaft 4 in the region of the thread eye 15. During the reforming process, the edge 9 is divided into sections, namely the sections 9*a*, 9*b*, that are located on the line 19 and terminate in the sections 9*d*, 9*e*, via an outward directed sharp bend or an arc, said latter sections extending from the line 19 and terminating in the central section 9*c*, which, in turn, is straight again.

The manufacture of the thusly produced flat ribbon heald 20 requires less use of material, when compared with conventional healds provided with wider metal ribbon sections. Compared with healds having widened end eyelets, more minimal local material deformations occur. The material selection may be optimized.

A complementary flat ribbon heald 21 can be produced from the flat ribbon heald blank 18. Again, a reformation process is used, in the course of which the center of the shaft 4 is brought onto the line 19 that marks the former course of the edge 9. As a result of this, the edge 9 is divided into the sections 9*a*, 9*b*, 9*c*, 9*d*, 9*e*. The above description of the flat ribbon heald blank 18 and the flat ribbon heald 20 applies analogously, using the same reference numbers.

Figure 6:
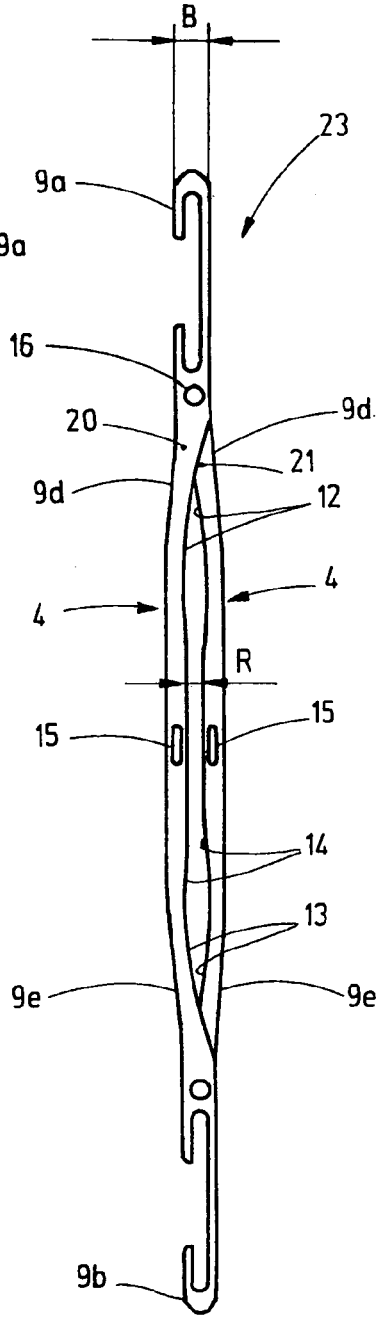
FIG. 6 shows the superimposed flat ribbon healds as in FIGS. 4 and 5.

When the flat ribbon healds 20, 21 are fittingly superimposed in the manner as they are lined up on the carrier rails as shown by FIG. 6, it is obvious that the shafts 4 are bent away from each other. Therefore, a distance R is created between the edge sections 14 of the shafts 4 in the region of the thread eyes 15, said distance being substantially greater than the distance D in accordance with FIG. 3. Preferably, the distance R has a size that is half the width B1 of the shaft 4, ideally the same size as the width B1 of the shaft 4.

Figure 7:
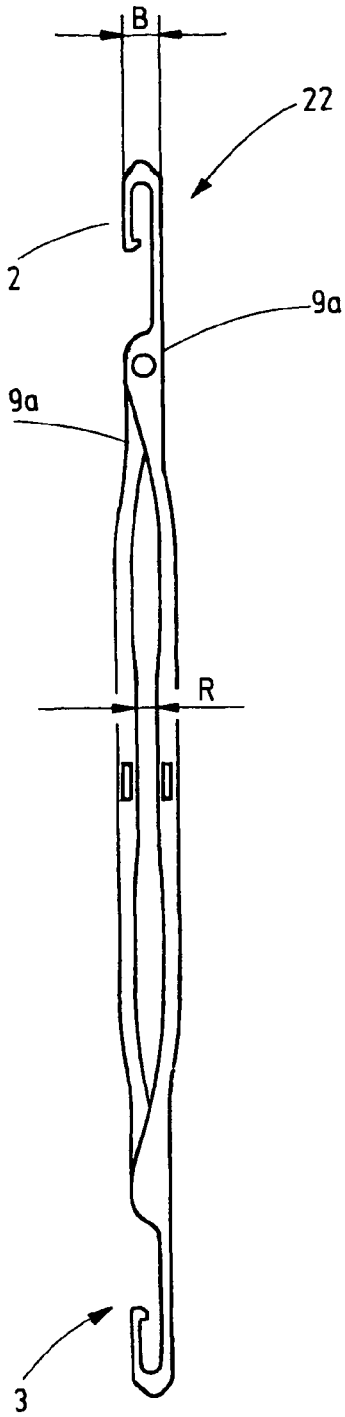
FIGS. 7 and 8 illustrate alternative embodiments of flat ribbon healds, each depicted by two associate differently cranked superimposed healds.

FIG. 7 shows a modified heald pair 22 with J-shaped end eyelets 2, 3. Other than that, the above descriptions apply analogously, using the same reference numbers.

Figure 8:
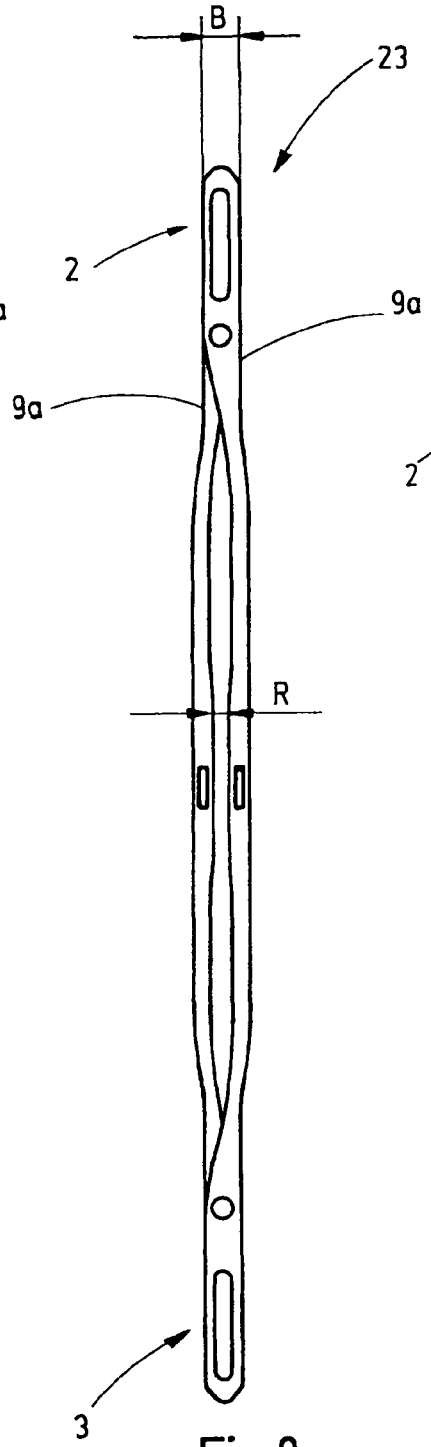

FIG. 8 shows a heald pair 23 with ring-shaped end eyelets 2, 3. Again, the above description applies analogously.

Figure 9:
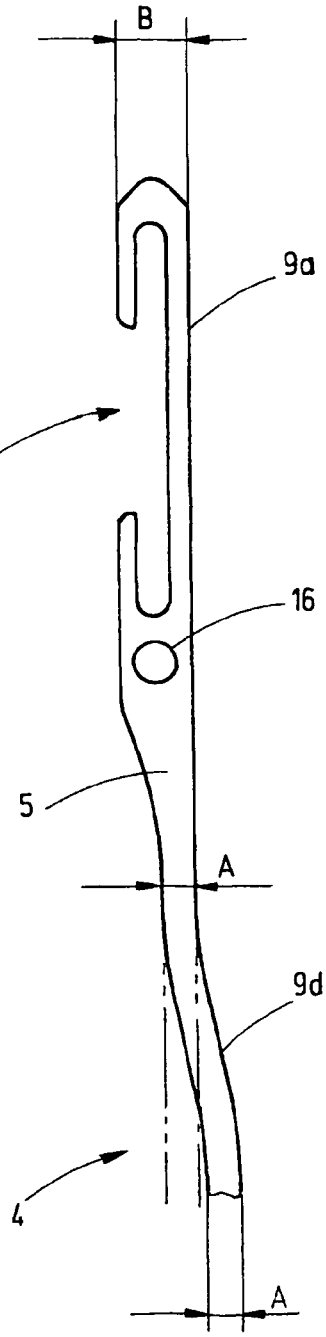
FIG. 9 shows a modified embodiment of a flat ribbon heald in accordance with the invention, showing its end region.

While, in all of the above exemplary embodiments, the offset of the section 9*c* of the edge 9 is provided on the transition sections 5, 6, it is also possible to move this offset into the region of the shaft 4. FIG. 9 shows such an example. While the transition region 5 reduces the width of the heald from the larger width B in the region of the end eyelet 2 to the amount of the smaller width A of the shaft 4, the straight section 9*a* of the edge 9 extends over the end eyelet 2, as well as over the transition region 5. The adjoining shaft 4 is cranked, so that the section 9*d* of the edge 9 is located in the region of the shaft 4. Also in this case the outward-facing section 9*d* directly adjoins the straight section 9*a* via an arc or a sharp bend.

The healds in accordance with the invention consist of a metal ribbon section having the width B that is narrower than the total width B+X required for the flat ribbon heald 20. The flat ribbon heald 20 has an essentially non-machined—in any event, not trimmed—edge 9 derived from the metal ribbon section and an edge 10, 11, 12, 13, 14 that has been produced, in the region of the shaft 4 and the transition regions 5, 6, by trimming the metal ribbon section. An outward-directed crank of the shaft 4 creates an enlarged distance R between two associate oppositely cranked flat ribbon healds of a heald pair 23 which comprises two oppositely cranked flat ribbon healds 20, 21.

It will be appreciated that the above description of the present invention is susceptible to various modifications, changes and modifications, and the same are intended to be comprehended within the meaning and range of equivalents of the appended claims.

LIST OF REFERENCE NUMBERS

1 Flat ribbon heald blank
2, 3 End eyelets
4 Shaft
5, 6 Transition region
7, 8 Openings
9, 9*a*-9*d* Edge

10, 11 Sections
12, 13, 14 Edge sections
15 Thread eye
16, 17 Openings
18 Flat ribbon heald blank
19 Line
20, 21 Flat ribbon heald
22, 23 Heald pair

The invention claimed is:

1. Flat ribbon heald with two end eyelets, a shaft extending between the end eyelets, and at least one thread eye provided on the shaft, said flat ribbon heald comprising a metal ribbon section having an original width (B) at the end eyelets, said width being unchanged, and having a smaller width (B1) along the shaft, said smaller width being reduced due to the removal of material, wherein, between each end eyelet and the shaft, a respective transition section is formed, in which transition section the width is reduced from the greater width (B) of the end eyelets to the smaller width (B1) of the shaft, wherein the end eyelets, the transition sections and the shaft are all located in a common plane, and wherein each end eyelet has a straight edge that lies on a straight line with the corresponding straight edge of the other end eyelet and which extends to a point at which the transition section or the shaft has an outward bend followed by a further bend causing the shaft to extend in a longitudinal direction of the heald with the thread eye being laterally off set and disposed at or beyond the straight line on which the straight edges of the end eyelets are located.

2. Flat ribbon heald in accordance with claim 1, wherein the end eyelet is configured so as to be ring-shaped and closed.

3. Flat ribbon heald in accordance with claim 1, wherein the end eyelet is configured so as to be open on one side.

4. Flat ribbon heald in accordance with claim 1, wherein, due to the outward bend, said offset corresponds to at least half the smaller shaft width (B1).

5. Method for manufacturing a flat ribbon heald with at least one end eyelet, a shaft extending away from the end eyelet, and at least one thread eye provided on the shaft, said method comprising the following measures:

providing a metal ribbon section having two outer edges that are parallel to each other, said edges being at a distance from each other that defines the width (B) of the metal ribbon section;

forming at least one end eyelet at one end of the ribbon section by producing an opening while the width (B) is maintained;

removing material along the shaft to be produced in order to reduce the width of the shaft and in order to form a transition section between the shaft and the end eyelet while maintaining one straight edge of the original metal ribbon section;

forming at least one thread eve in the shaft; and, deforming the transition section created between the end eyelet and the shaft, or deforming the shaft in order to provide the straight edge, thus the shaft, with a lateral offset such that the thread eye is laterally offset and located at or laterally beyond the original location of the straight edge.

6. Method as in claim 5, wherein in order to produce the shaft and the transition region of the flat ribbon heald, material is removed only along one of the two edges of the metal ribbon section.

* * * * *